US010337707B2

(12) United States Patent
Jurik et al.

(10) Patent No.: US 10,337,707 B2
(45) Date of Patent: Jul. 2, 2019

(54) LUMINAIRE WITH ARTICULATED LEDS

(71) Applicant: ROBE LIGHTING SRO, Roznov pod Radhostem (CZ)

(72) Inventors: Pavel Jurik, Postredni Becva (CZ); Josef Valchar, Postredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 15/024,007

(22) PCT Filed: Nov. 20, 2014

(86) PCT No.: PCT/US2014/066478

§ 371 (c)(1),
(2) Date: Mar. 22, 2016

(87) PCT Pub. No.: WO2015/077384

PCT Pub. Date: May 28, 2015

(65) Prior Publication Data

US 2016/0245490 A1 Aug. 25, 2016

Related U.S. Application Data

(60) Provisional application No. 61/950,381, filed on Mar. 10, 2014, provisional application No. 61/907,818, filed on Nov. 22, 2013.

(51) Int. Cl.
*F21V 21/15* (2006.01)
*F21V 15/01* (2006.01)
(Continued)

(52) U.S. Cl.
CPC ..... *F21V 21/15* (2013.01); *F21V 7/0091* (2013.01); *F21V 14/02* (2013.01); *F21V 15/01* (2013.01);
(Continued)

(58) Field of Classification Search
CPC ..... F21V 21/15; F21V 7/0091; F21V 14/02; F21V 15/01; F21V 21/30; F21Y 2115/10
See application file for complete search history.

(56) References Cited

U.S. PATENT DOCUMENTS 6,814,459 B2 * 11/2004 Pederson ..... B60Q 1/2611 340/472
9,609,720 B2 * 3/2017 Woytowitz ..... F21V 21/15
(Continued)

FOREIGN PATENT DOCUMENTS

CN 204345517 U 5/2015
WO 2006125792 A1 11/2006

OTHER PUBLICATIONS

Office Action dated Jun. 16, 2017; U.S. Appl. No. 15/078,826 filed Mar. 23, 2016; 10 pages.
(Continued)

*Primary Examiner* — Tracie Y Green
(74) *Attorney, Agent, or Firm* — Conley Rose, P.C.; Grant Rodolph; Brooks W. Taylor

(57) ABSTRACT

Described is a method for controlling the movement of LED devices in luminaires, specifically to a method relating to allowing both synchronized and independent pan and tilt movement of LED light modules in a light curtain. The LEDs may be mounted in a plurality of modules. The modules may be in a linear arrangement. The LEDs may be mounted in a plurality of modules that are arrayed in a two dimensional array. The modules in the linear arrangement or in the two dimensional array may be mounted in groups forming modular group assemblies where modular group assembly are independently articulated to pan and/or tilt the modules mounted thereon independent of other modular group assemblies.

10 Claims, 10 Drawing Sheets

(51) Int. Cl.

| | |
|---|---|
| ***F21V 14/02*** | (2006.01) |
| ***F21V 7/00*** | (2006.01) |
| ***F21V 21/30*** | (2006.01) |
| *F21W 131/406* | (2006.01) |
| *F21Y 105/00* | (2016.01) |
| *F21Y 115/10* | (2016.01) |
| *F21Y 101/00* | (2016.01) |

(52) U.S. Cl.
CPC ..... *F21V 21/30* (2013.01); *F21W 2131/406* (2013.01); *F21Y 2101/00* (2013.01); *F21Y 2105/00* (2013.01); *F21Y 2115/10* (2016.08)

(56) References Cited

U.S. PATENT DOCUMENTS

| | | | | |
|---|---|---|---|---|
| 10,018,338 | B2 | 7/2018 | Jurik et al. | |
| 2008/0068839 | A1* | 3/2008 | Matheson | F21S 2/005 362/249.07 |
| 2010/0135007 | A1* | 6/2010 | Seabrook | F21V 5/04 362/218 |
| 2012/0307486 | A1* | 12/2012 | Gordin | F21S 4/00 362/223 |
| 2014/0254162 | A1* | 9/2014 | Holland | F21V 21/15 362/272 |
| 2015/0016106 | A1 | 1/2015 | Belliveau et al. | |
| 2015/0062902 | A1 | 3/2015 | Velazquez | |

OTHER PUBLICATIONS

Notice of Allowance dated Feb. 15, 2018; U.S. Appl. No. 15/078,826, filed Mar. 23, 2016; 10 pages.

PCT International Search Report; Application No. PCT/US2014/066478; dated Apr. 15, 2015; 3 pages.

PCT Written Opinion of the International Searching Authority; Application No. PCT/US2014/066478; dated Apr. 15, 2015; 6 pages.

PCT International Search Report; Application No. PCT/US2017/023872; dated Sep. 5, 2017; 4 pages.

PCT Written Opinion of the International Searching Authority; Application No. PCT/US2017/023872; dated Sep. 5, 2017; 7 pages.

* cited by examiner

LUMINAIRE WITH ARTICULATED LEDS

CROSS-REFERENCE TO RELATED APPLICATIONS

This application is a U.S. National stage of International Patent Application No. PCT/US2014/066478 filed Nov. 20, 2014 by Pavel Jurik, et al. entitled, "Luminarie with Articulated LEDs", which claims priority to U.S. Provisional Application No. 61/950,381 filed Mar. 10, 2014 by Pavel Jurik, et al. entitled, "Method for Controlling the Movement of LEDs in a Luminarie". International Patent Application No. PCT/US2014/066478 also claims priority to U.S. Provisional Application No. 61/907,818 filed Nov. 22, 2013 by Pavel Jurik, et al. entitled, "System and Method for Controlling the Movement of LEDs in a Luminarie."

TECHNICAL FIELD OF THE DISCLOSURE

The present disclosure generally relates to a method for controlling the movement of light emitting diode (LED) devices in luminaires, specifically to a method relating to allowing both synchronized and independent movement of LEDs in a light curtain.

BACKGROUND OF THE DISCLOSURE

Luminaires with automated and remotely controllable functionality are well known in the entertainment and architectural lighting markets. Such products are commonly used in theatres, television studios, concerts, theme parks, night clubs and other venues. A typical product will provide control over the functions of the luminaire allowing the operator to control the intensity and color of the light beam from the luminaire that is shining on the stage or in the studio. Many products also provide control over other parameters such as the position, focus, beam size, beam shape and beam pattern. In such products that contain light emitting diodes (LEDs) to produce the light output it is common to use more than one color of LEDs and to be able to adjust the intensity of each color separately such that the output, which comprises the combined mixed output of all LEDs, can be adjusted in color. For example, such a product may use red, green, blue, and white LEDs with separate intensity controls for each of the four types of LED. This allows the user to mix almost limitless combinations and to produce nearly any color they desire.

FIG. 1 illustrates a typical multiparameter automated luminaire system 10. These systems typically include a plurality of multiparameter automated luminaires 12 which typically each contain on-board a light source (not shown), light modulation devices, electric motors coupled to mechanical drive systems, and control electronics (not shown). In addition to being connected to mains power either directly or through a power distribution system (not shown), each luminaire is connected in series or in parallel to data link 14 to one or more control desks 15. The automated luminaire system 10 is typically controlled by an operator through the control desk 15.

A known arrangement for luminaires used in the entertainment or architectural market is that of a light curtain. A light curtain consists of a row or line of light emitters arranged so that they produce a plane of light, like a curtain thus the name. Prior art automated products have allowed the combined movement of all the light emitters together in tilting or rocking motion so as to be able to direct the curtain of light as desired. An example of such a prior art luminaire is the CycFX 8 from Robe Lighting. However, the prior art devices don't allow individual light emitters in the curtain to be adjusted from position(s) independently of each other. Such adjustment would be useful, as it would allow the user or lighting designer to produce converging or diverging curtains, and to direct the light more accurately where it is needed. It would also be useful with other shapes and types of luminaires, not just light curtains, to be able to individually adjust the position of individual light emitters.

There is a need for a method for controlling the movement of LED devices in luminaires, specifically to a method relating to allowing both synchronized and independent movement of LEDs in a light curtain or other luminaires.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION OF THE DISCLOSURE

Preferred embodiments of the present disclosure are illustrated in the FIGUREs, like numerals being used to refer to like and corresponding parts of the various drawings.

The present disclosure generally relates to a method for controlling the movement of LED devices in luminaires, specifically to a method relating to allowing both synchronized and independent movement of LED light modules in a light curtain or other LED luminaires.

Figure 1:
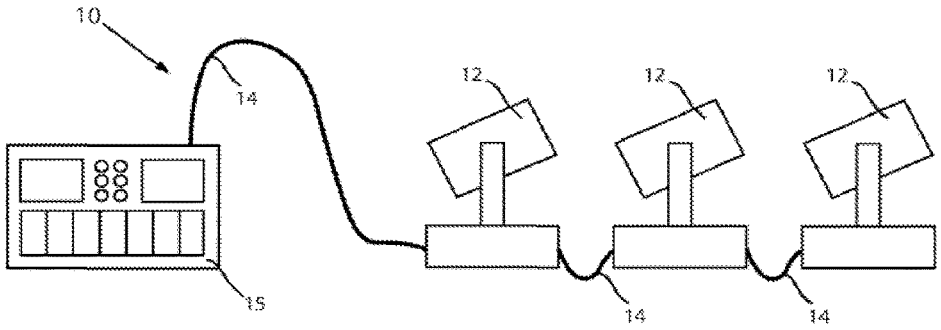
FIG 1 Prior Art
FIG. 1 illustrates a multiparameter automated luminaire lighting system.
Figure 2:
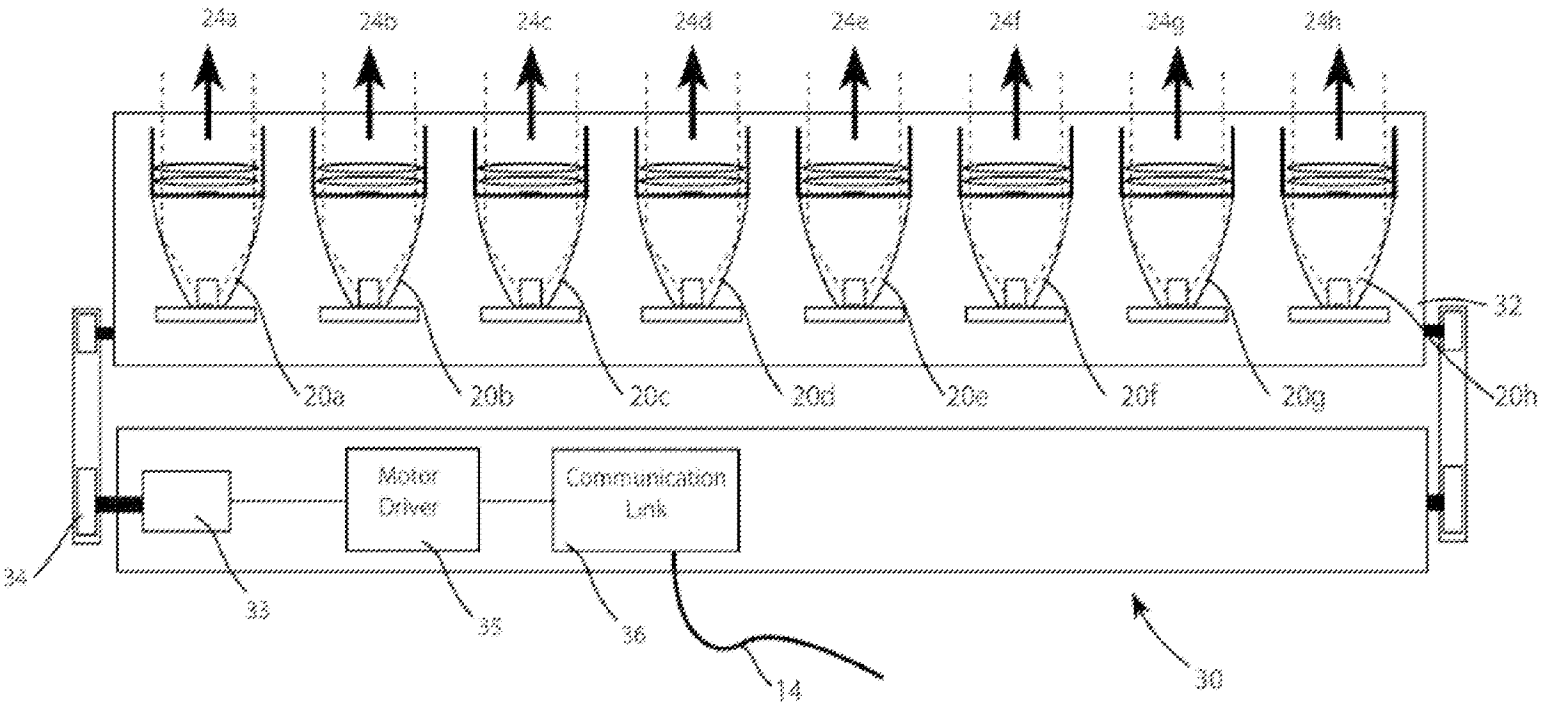
FIG. 2 illustrates an embodiment of a luminaire with a linear arrangement of a plurality of light emitting modules.

FIG. 2 illustrates an embodiment of a luminaire 30 with a linear arrangement of a plurality of light-emitting modules. In the embodiment illustrated eight light-emitting modules

20*a-h* are mounted within luminaire body 32 which serves as a common carrier to carry the light-emitting modules 20*a-h* in a linear arrangement to form light curtain luminaire 30. Each light-emitting module 20*a-h* emits collimated and controlled light beams 24*a-h*. Each of these light-emitting modules 24*a-h* may be individually adjusted for color, by adjusting the output mix of its LED emitters, and for beam angle, by adjusting each modules optical elements. In this configuration all the light-emitting modules are aligned to point in the same direction and same plane. The luminaire body 32 may be articulated to be capable of a global tilting motion through motor 33 and drive mechanism 34. Motor 33 may be controlled from data link 14 through communication link 36 and motor driver 35. Though not shown in this figure the common carrier may also be articulated to be capable of a global panning motion through motors and motor drivers which are controlled by an operator through the communication link 36.

Figure 5:
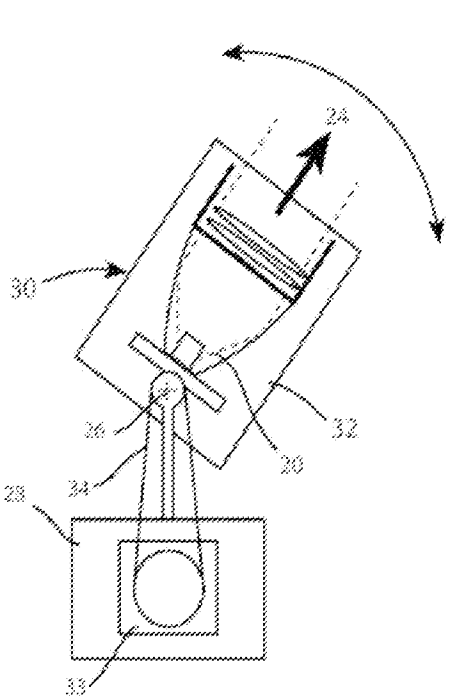
FIG. 5 illustrates the global tilting motion of the light emitting modules in an embodiment of the luminaire illustrated in FIG. 2 where the modules are tilted off of the central orientation illustrated in FIG. 3 but in the opposite direction as illustrated in FIG. 4.
Figure 4:
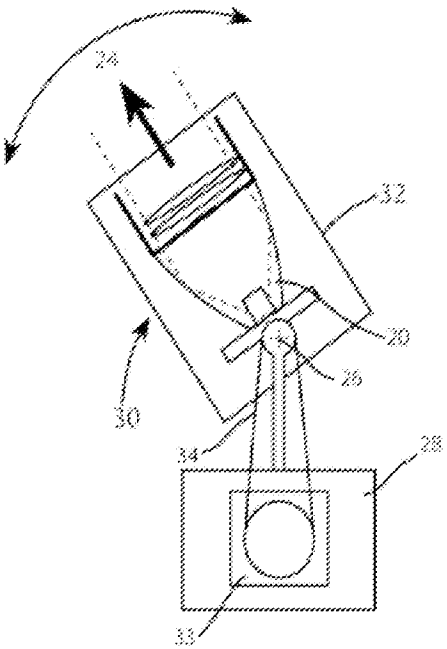
FIG. 4 illustrates the global tilting motion of the light emitting modules in an embodiment of the luminaire illustrated in FIG. 2 where the modules are tilted off of the central orientation illustrated in FIG. 3.
Figure 3:
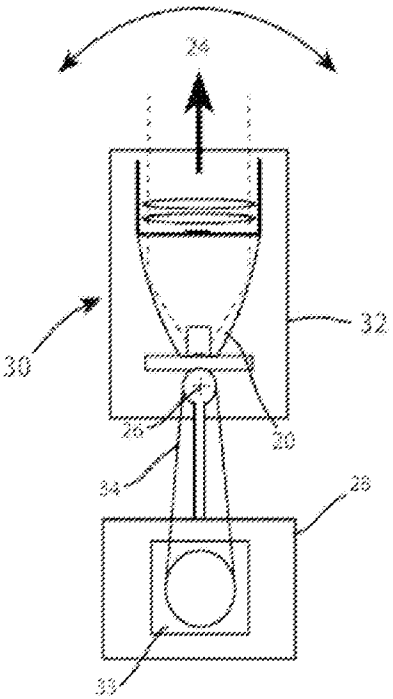
FIG. 3 illustrates the global tilting motion of the light emitting modules in an embodiment of the luminaire illustrated in FIG. 2 where the modules are centrally oriented.

FIGS. 3, 4, and 5 illustrate the global tilting motion of the light-emitting modules in an embodiment of the disclosure. The view in FIGS. 3, 4, and 5 is an elevation view of the luminaire 30 shown in FIG. 2, viewed from the end of the luminaire, orthogonal to that shown in FIG. 2. Luminaire body 32 may be pivotably mounted to frame 28 such that the luminaire body can rotate about pivot axis 26. FIG. 3 shows the luminaire body 32 positioned such that the light-emitting modules 20 are vertical and light beams 24 are emitted vertically. FIGS. 4 and 5 show the luminaire body rotated around pivot axis 26 such that the light-emitting modules 20, and thus the light beams 24, are tilted to the left and right respectively.

This tilting motion around pivot axis 26 is controlled through a motor 33 and drive mechanism 34 actuation/articulation system. The actuation/articulation system may be a stepper motor, servo motor, linear actuator, solenoid, direct current (DC) motor, or other mechanism many of which are well known in the art. The drive mechanism 34 of the embodiment shown in FIGS. 2-5 is a belt drive mechanism mechanically coupling the motor 33 to the luminaire body 32. This tilting motion may be controlled remotely as with other features of an automated luminaire, perhaps through an industry standard protocol such as DMX-512 through data link 14, communication link 36 and motor driver 35 on board the luminaire. In other embodiments, configurations are possible. This tilting motion imparts the same movement to each and every light-emitting module in luminaire 30 identically. They will all move in parallel and mechanical synchronization.

Figure 6:
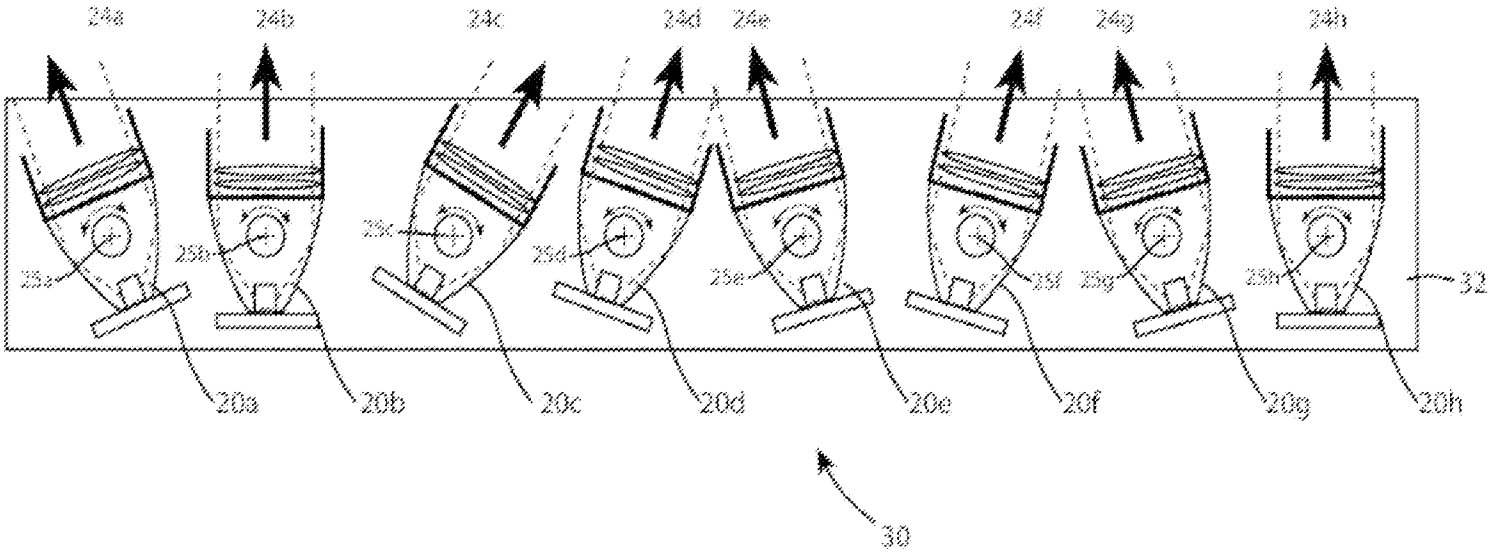
FIG. 6 illustrates an embodiment with independent panning motion of the light emitting modules in an embodiment of the disclosure.

FIG. 6 illustrates the independent panning motion of the light emitting modules in an embodiment of the disclosure. FIG. 6 shows the same view of luminaire 30 as FIG. 2. In this embodiment light-emitting modules 20*a-h* are each individually and separately pivotably mounted to luminaire body 32 such that the light-emitting modules 20*a-h* can individually rotate about respective pivot axes 25*a-h*. The plane of rotation of pivot axes 25*a-h* is orthogonal to pivot axis 26 shown in FIGS. 3, 4, and 5. Pivot axes 25*a-h* allow each light-emitting module 20*a-h* to pan from side to side individually and independent of the position of its neighboring light-emitting modules, thus allowing light beams 24*a-h* to be individually and separately steered. These individual independent tilt articulators tilting motion around pivot axes 25*a-h* may be actuated through a stepper motor, servo motor, linear actuator, solenoid, DC motor, or other mechanism as well known in the art.

Figure 7:
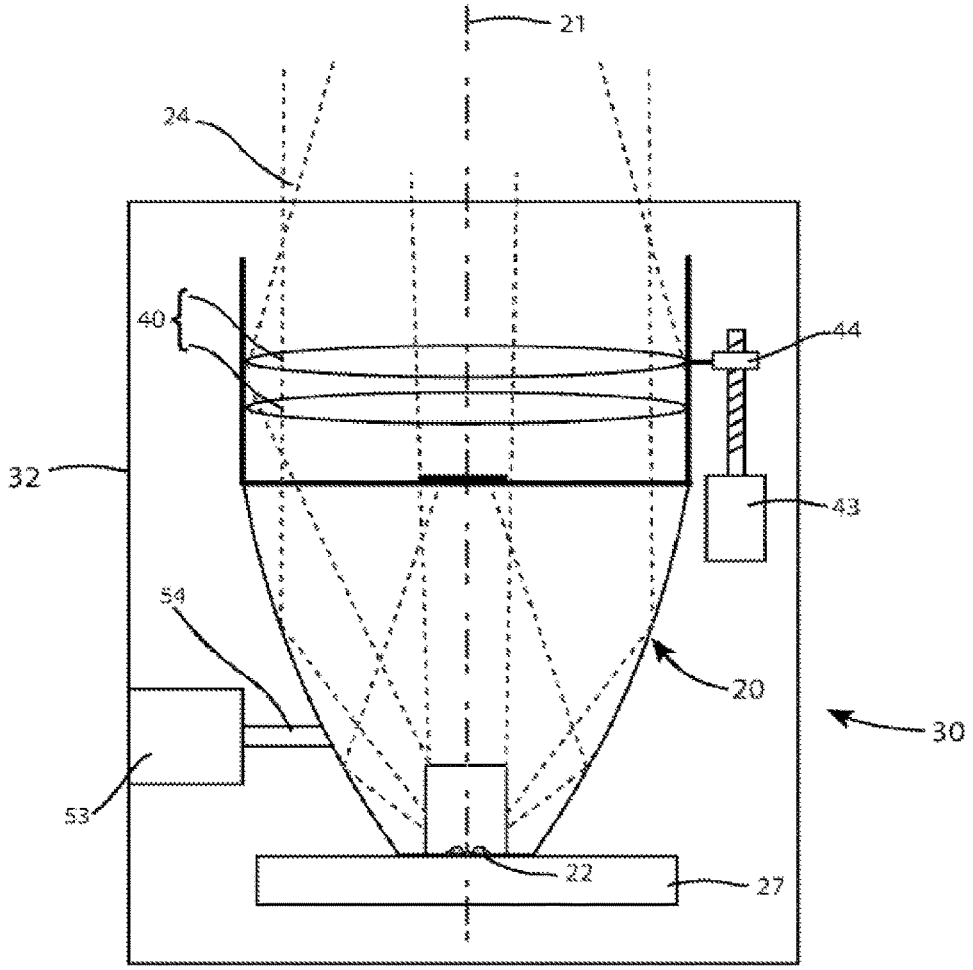
FIG. 7 illustrates an embodiment of a light emitting module.

FIG. 7 illustrates the light-emitting module 20 of an embodiment of the disclosure. LED emitters 22 may be mounted to or be otherwise in thermal contact with a heat sink 27. The optics of light-emitting module 20 may comprise total internal reflection (TIR) optical systems or standard reflectors such as are well known in the art so as to provide a collimated light beam 24 along the optical axis 21. Light-emitting module 20 may further contain optical elements 40 such that the focal length and thus the beam angle of the emitted light may be adjusted. Such focal length adjusting optical elements 40 are coupled via drive mechanism 44 to a motor 43 such that the beam angle change can be remotely controlled. This actuation system may be a stepper motor, servo motor, linear actuator, solenoid, DC motor, or other mechanism many of which are well known in the art.

In various embodiments of the disclosure each LED emitter 22 may comprise a single LED die of a single color or a group of LED dies of the same or differing colors. For example in one embodiment LED emitter 22 may comprise one each of a Red, Green, Blue and White LED die. In further embodiments LED emitter 22 may comprise LED chip or package while in yet further embodiments LED emitter 22 may comprise multiple LED chips or packages either under a single primary optic or each package with its own primary optic. In some embodiments these LED die(s) may be paired with optical lens element(s) as part of the LED light-emitting module.

The two orthogonal movements described herein about pivot axes 25*a-h*, and 26 are commonly referred to as pan and tilt directions. In operation, the user or lighting designer may rotate the entire luminaire 30 around the tilt pivot axis 26, and individually pan each light-emitting module 20*a-h* in order to achieve the desired effect from the luminaire light curtain. FIG. 7 illustrates an independent pan articulator employing a direct motor drive 53, 54 of the actuation system for panning an individual light-emitting module 20. This actuation system may be a stepper motor, servo motor, linear actuator, solenoid, DC motor, or other mechanism many of which are well known in the art.

Figure 8:
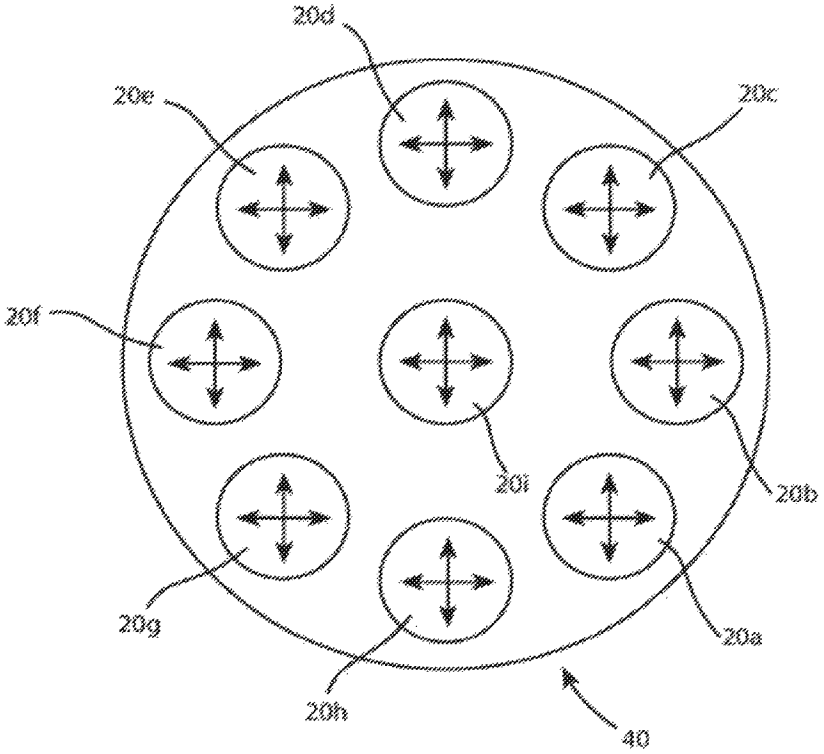
FIG. 8 illustrates a further embodiment of independent panning and tilting motion of the light emitting modules.

FIG. 8 illustrates a further embodiment of the disclosure. In this embodiment, 9 light-emitting modules 20*a*-20*i* are mounted in a luminaire 40. Each light-emitting module 20*a*-20*i* emits collimated and controlled light. Each of the light beams from the light-emitting modules 20*a*-20*i* may be individually adjusted for color, by adjusting the output mix of its LED emitters, and for beam angle, by adjusting each modules optical elements as previously described. Further, each light-emitting module 20*a*-20*i* may be individually articulated to adjust for both pan and tilt. This differs from the prior embodiment where each light-emitting module had a single independent axis of tilt movement, and a global movement of the luminaire provided pan. In the embodiment illustrated in FIG. 8 each light-emitting module 20*a*-20*i* is capable of both independent pan and independent tilt. Further, luminaire 40 may also have global pan and global tilt available. Independent pan and tilt of each light-emitting module 20*a*-20*i* provides the ability to widen and narrow the combined beam produced by the modules, while the global pan and tilt of luminaire 40 provides the ability, as usually provided by an automated luminaire, to steer the resultant combined beam as desired.

Figure 9:
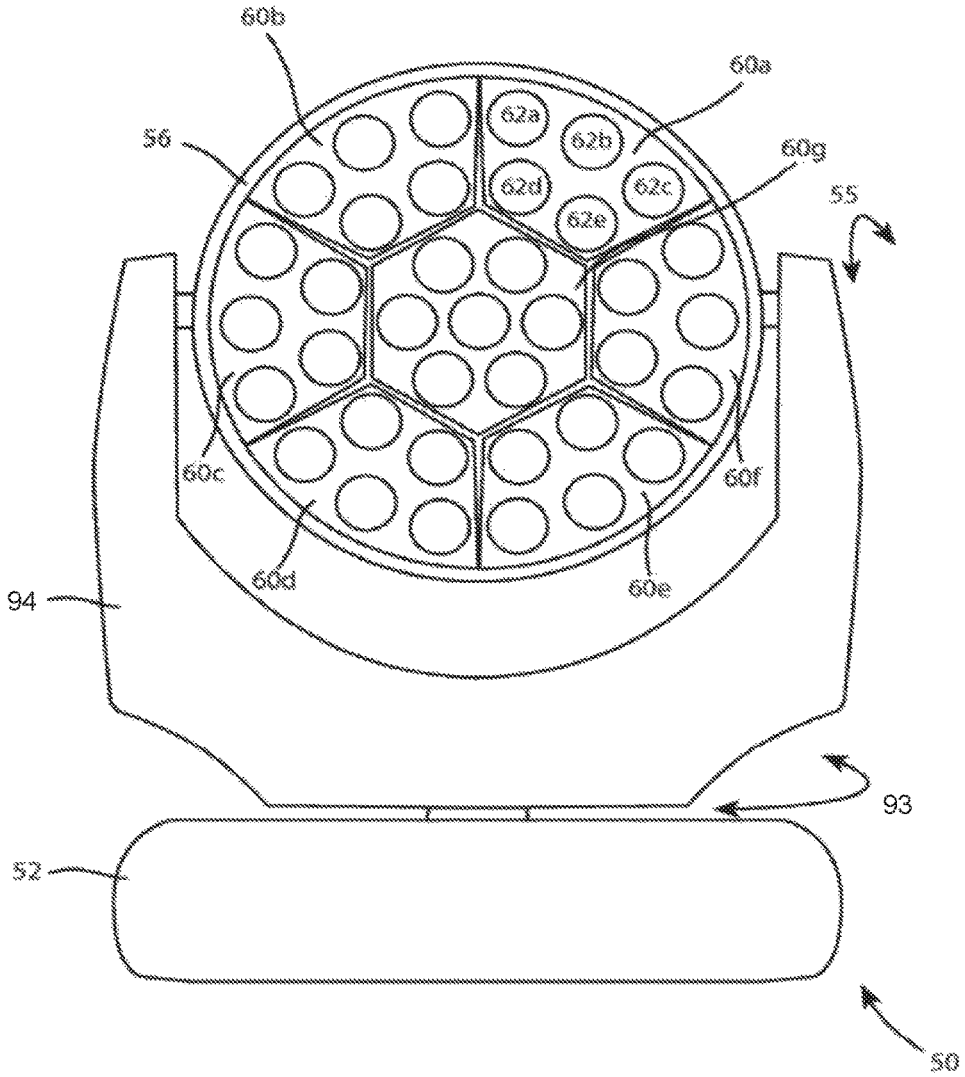
FIG. 9 illustrates a further embodiment of independent panning and tilting motion of the light emitting modules.

FIG. 9 illustrates a further embodiment of the disclosure. In this embodiment, 37 light-emitting modules are mounted in the head 56 of luminaire 50. The light-emitting modules are mounted in groups to form seven module group assemblies, 60*a*-60*g*. For example, module group assembly 60*a* contains five light-emitting modules 62*a*-62*e*. Each of the 37 light-emitting modules emits collimated and controlled light. Each of the light beams from the light-emitting modules may be individually adjusted for color, by adjusting the output mix of its LED emitters, and for beam angle, by adjusting each modules optical elements as previously described. In the embodiment illustrated in FIG. 9 each module group assembly 60*a*-60*g* is capable of both independent pan and independent tilt.

Head 56 may be mounted in a yoke assembly 94 that, in turn, is mounted on base 52. Yoke assembly 94 is rotatably mounted on base 52 so as to provide global pan rotation 93 and head 56 is rotatably mounted in yoke assembly 94 so as to provide global tilt rotation 55.

Figure 10:
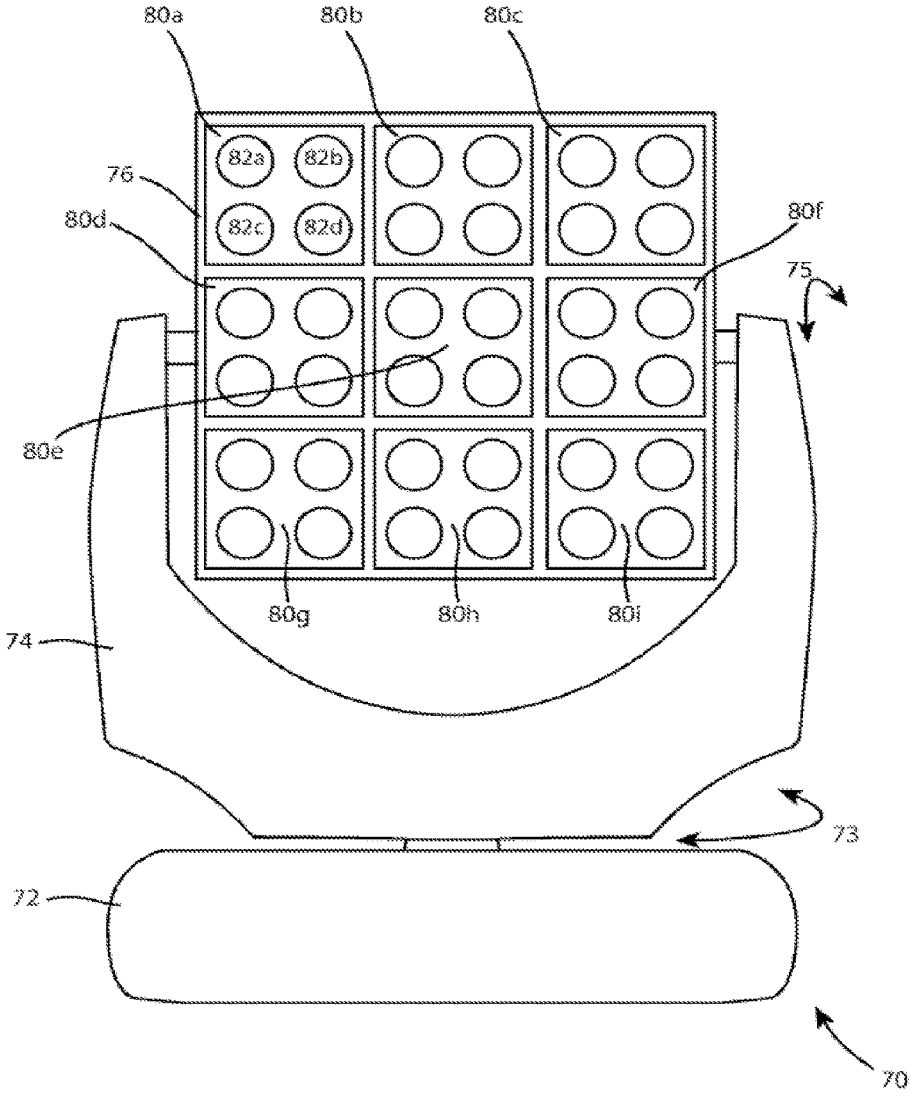
FIG. 10 illustrates a further embodiment of independent panning and tilting motion of the light emitting modules.

FIG. 10 illustrates a further embodiment of the disclosure. In this embodiment 36 light-emitting modules are mounted in the head 76 of luminaire 70. The light-emitting modules are mounted in groups to form nine module group assemblies, 80*a*-80*i*. For example, module group assembly 80*a* contains four light-emitting modules 82*a*-82*d*. Each of the 36 light-emitting modules emits collimated and controlled light. Each of the light beams from the light-emitting modules may be individually adjusted for color, by adjusting the output mix of its LED emitters, and for beam angle, by adjusting each modules optical elements as previously described. In the embodiment illustrated in FIG. 10 each module group assembly 80*a*-80*i* is capable of both independent pan and independent tilt.

Head 76 may be mounted in a yoke assembly 74 that, in turn, is mounted on base 72. Yoke assembly 74 is rotatably mounted on base 72 so as to provide global pan rotation 73 and head 76 is rotatably mounted in yoke assembly 74 so as to provide global tilt rotation 75.

Although the embodiments illustrated herein show specific numbers of light-emitting modules mounted in specific numbers of module assemblies, in practice the disclosure is not so limited and any number of light-emitting modules may be mounted in any number of module assemblies to form a luminaire. In any of the possible arrangements, each of the light-emitting modules and/or each of the module assemblies may be capable of independent pan and independent tilt movement in one or more axes. Further, the light-emitting modules and/or module assemblies may be arranged in any shape or layout. Embodiments herein illustrate linear, round and square arrangements, but any arrangement shape may be used.

Figure 11:
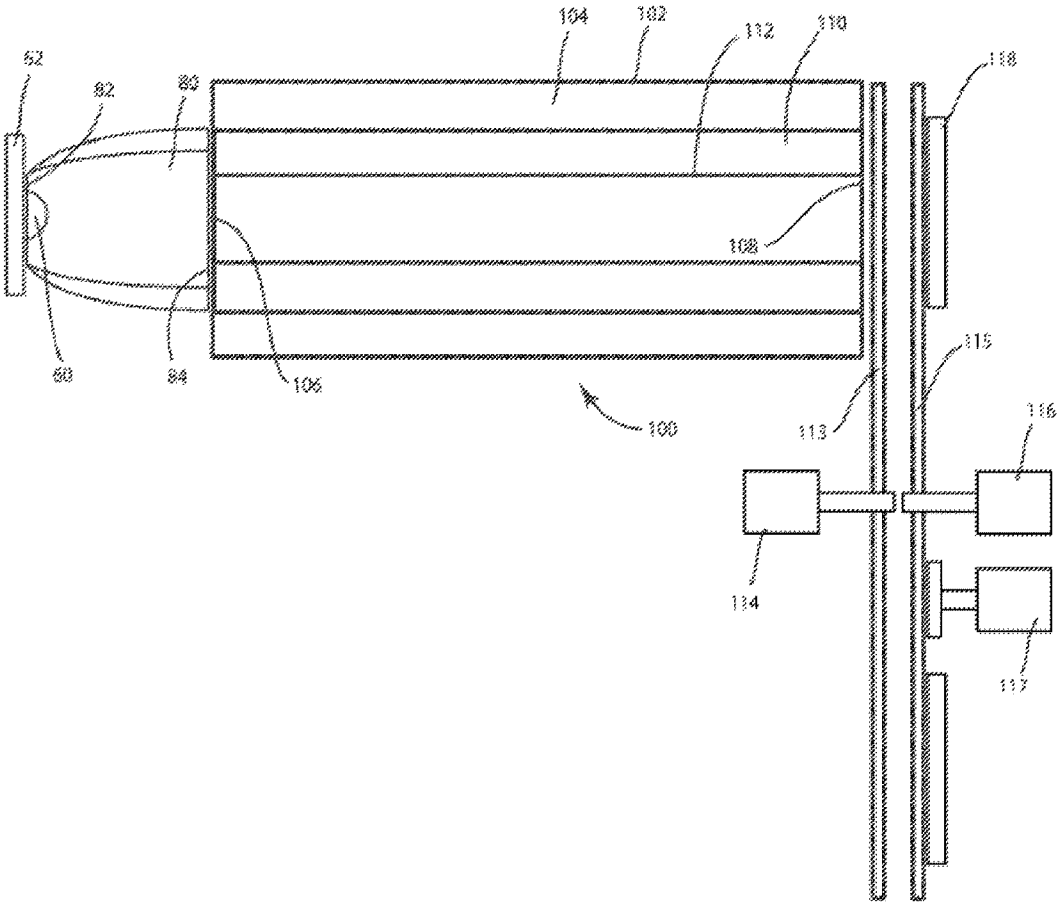
FIG. 11 illustrates an embodiment of the disclosure using a gobo wheel.

FIG. 11 illustrates a further embodiment of the light-emitting module 100 of the disclosure. LED 60, which may include a primary optic, is mounted on substrate 62. LED 60 may contain a single color die or may contain multiple dies, each of which may be of differing colors. The light output from the dies in LED 60 enters collimating and mixing optic 80 at light entry port 82. Collimating and mixing optic 80 may be a solid optic using total internal reflection (TIR) to direct the light or may be a hollow reflective surface. Collimating and mixing optic 80 may have four sides, each of which may be curved with cornered sides. The combination square sided shape with curved sides provides excellent mixing of the light from the dies in LED 60. A further feature of collimating and mixing optic 80 is that it directs the reflected light to an external focal point that is comparatively close to its output port 84 of the collimating and mixing optic 80. In the embodiment shown in FIG. 11, the reflected light exits collimating and mixing optic 80 at output port 84 and enters light integrator optic 102 at its entry port 106. Light integrator optic 102 is a device utilizing internal reflection so as to collect, homogenize and constrain and conduct the light from collimating and mixing optic 80. Light integrator optic 102 may be a hollow tube with a reflective inner surface such that light impinging into the entry port 106 may be reflected multiple times along the tube before leaving at the exit port 108. Light integrator optic 102 may be a square tube, a hexagonal tube, a heptagonal tube, an octagonal tube, a circular tube, or a tube of any other cross section. In a further embodiment light integrator optic 102 may be a solid rod constructed of glass, transparent plastic, or other optically transparent material where the reflection of the incident light beam within the rod is due to total internal reflection (TIR) from the interface between the material of the rod and the surrounding air. The integrating rod may be a square rod, a hexagonal rod, a heptagonal rod, an octagonal rod, a circular rod, or a rod of any other cross section. Integrator embodiments with a polygonal cross section have reflective sides 110 and corners 112 between the reflective sides as seen in FIG. 11 which includes a side cross sectional view of the light integrator optic 102.

A feature of a light integrator optic 102 which comprises a hollow tube or solid rod where the sides of the rod or tube are essentially parallel and the entry port 106 and exit port 108 are of the same size is that the divergence angle of light exiting the light integrator optic 102 at exit port 108 will be the same as the divergence angle for light entering the light integrator optic 102 at entry port 106. Thus, a parallel sided light integrator optic 102 has no effect on the beam divergence and will transfer the position of the focal point of collimating and mixing optic 80 at its output port 84 to the light integrator optic's 102 exit port 108. The light exiting light integrator optic 102 will be well homogenized with all the colors of LED 60 mixed together into a single colored light beam and may be used as our output, or may be further modified by downstream optical systems.

Light integrator optic 102 may advantageously have an aspect ratio where its length is much greater than its diameter. The greater the ratio between length and diameter, the better the resultant mixing and homogenization will be. Light integrator optic 102 may be enclosed in a tube or sleeve 104 that provides mechanical protection against damage, scratches, and dust.

In the embodiment illustrated in FIG. 11, the optical system is further fitted with a gobo wheel 113. A gobo wheel contains patterns or images that will controllably mask the light exiting through exit port 108. These images will then be projected by downstream optical elements to create a pattern projecting light beam. The lens system after the gobo wheel 113 may be a zoom lens system 40 such as shown in FIG. 7 or any other projecting lens system as well known in the art. Gobo wheel 113 may be rotated through motor 114 in order to select different gobo patterns in front of exit port 108. A rotating gobo wheel 115 may additionally or alternatively be utilized in the system. Rotating gobo wheel 115 may be rotated through motor 116 in order to select different gobo patterns 118 in front of exit port 108. Gobo patterns 118 may then be rotated about the optical axis of the system through motor 117.

Figure 12:
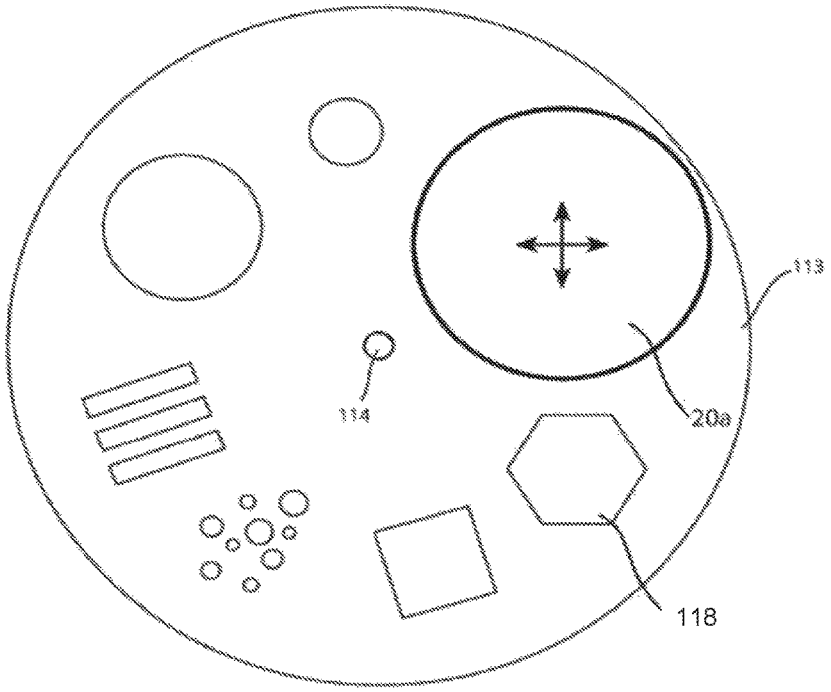
FIG. 12 illustrates detail of a gobo wheel embodiment of FIG. 11.

FIG. 12 shows gobo wheel 113 in more detail in a further embodiment of the disclosure. Gobo wheel 113 contains a plurality of gobo patterns 118 that may be moved across and in front of light-emitting module 20*a* by rotation about motor 114 and will move with it as it is panned and tilted. In other embodiments every light-emitting module as illustrated in FIG. 7, 8, 9 or 10 may be fitted with a gobo wheel, all or any of which may be individually or cooperatively controlled. In further embodiments the gobo wheel may not be a complete circular disc as shown in FIG. 12, but may be a portion of a disc, or a flag so as to save space and provide a more limited number of gobo patterns 118. The gobo patterns 118 may be of any shape and may include colored images or transparencies. In yet further embodiments, individual gobo patterns 118 may be further rotated about their axes by supplementary motors in order to provide a moving rotating image. Such rotating gobo wheels are well known in the art.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

What is claimed is:

1. A luminaire, comprising:

a plurality of LED modules into which are mounted at least one LED;

a common carrier in which the plurality of LED modules are mounted;

a global articulation motor;

a physical drive mechanism mechanically coupling the global articulation motor to the common carrier, the global articulation motor and the physical drive mechanism being configured to rotate the common carrier around a first pivot axis;

a plurality of independent articulators which independently articulate corresponding individual LED module around individual second pivot axes, wherein the second pivot axes are different from the first pivot axis;

wherein each LED module is individually and separately pivotably mounted to the common carrier, wherein movement of each LED module around its second pivot axis is independent of movement of a neighboring LED module around its second pivot axis.

2. The luminaire of claim 1, wherein the second pivot axes are orthogonal to the first pivot axis.

3. The luminaire of claim 1, wherein the global articulator further comprises:

a communication link configured to receive signals; and a motor driver coupled to the communication link and the global articulation motor, and configured to control the global articulation motor based on the signals received by the communication link.

4. The luminaire of claim 1, wherein at least one of the independent articulators comprises a motor configured to articulate the corresponding individual LED module.

5. The luminaire of claim 4, wherein the corresponding individual LED module is articulated by direct motor drive.

6. The luminaire of claim 1, wherein at least one of the plurality of LED modules comprises one each of red, green, blue, and white LED dies.

7. The luminaire of claim 1, wherein at least one of the plurality of LED modules comprises an optical system configured to generate a collimated light beam.

8. The luminaire of claim 1, wherein at least one of the plurality of LED modules comprises one or more lenses configured to move along an optical axis of the luminaire to control a beam angle of a light beam emitted by the luminaire.

9. The luminaire of claim 8, further comprising a motor configured to adjust a position of the one or more lenses to provide remote control of the beam angle.

10. The luminaire of claim 1, wherein the physical drive mechanism comprises a belt drive mechanism.

* * * * *